US007059925B2

(12) United States Patent
Smith et al.

(10) Patent No.: US 7,059,925 B2
(45) Date of Patent: Jun. 13, 2006

(54) LIFE PRESERVER SYSTEM

(75) Inventors: Jonathan Smith, Waterside (CA); Michael O'Connell, Grenville (CA)

(73) Assignee: Tulmar Safety Systems, Inc. (CA)

( * ) Notice: Subject to any disclaimer, the term of this patent is extended or adjusted under 35 U.S.C. 154(b) by 0 days.

(21) Appl. No.: 11/037,433

(22) Filed: Jan. 18, 2005

(65) Prior Publication Data

US 2005/0221701 A1 Oct. 6, 2005

Related U.S. Application Data

(60) Provisional application No. 60/558,097, filed on Apr. 1, 2004.

(51) Int. Cl.
*B63C 9/08* (2006.01)

(52) U.S. Cl. ..... 441/106; 441/119

(58) Field of Classification Search ..... 441/88, 441/92, 106, 119, 123
See application file for complete search history.

(56) References Cited

U.S. PATENT DOCUMENTS

| | | | | |
|---|---|---|---|---|
| 3,329,982 | A * | 7/1967 | Zannoni | 441/92 |
| 3,345,657 | A * | 10/1967 | Peeler et al. | 441/92 |
| 4,060,867 | A * | 12/1977 | Miller | 441/92 |
| 5,692,933 | A * | 12/1997 | Bradley et al. | 441/106 |
| 6,004,177 | A * | 12/1999 | Biesecker et al. | 441/92 |
| 6,837,764 | B1 * | 1/2005 | Bradley | 441/106 |

* cited by examiner

*Primary Examiner*—Lars A. Olson
(74) *Attorney, Agent, or Firm*—Barnes & Thornburg LLP

(57) ABSTRACT

An inflatable life preserver, capable of being in an inflated state and an uninflated state, is disclosed. The life preserver includes a structural overshell which defines the size and shape of the life preserver in the inflated state and a gas retention bladder fitted within the overshell. The overshell bears the expansion force of a gas within the bladder in the inflated state. The overshell defines inflatable side portions which are confined to sides of at least a portion of a chest area of a wearer, when the life preserver is in an uninflated state, and, which extend laterally over the chest area of the wearer, when the life preserver is in an inflated state.

19 Claims, 11 Drawing Sheets

LIFE PRESERVER SYSTEM

CROSS-REFERENCE TO RELATED APPLICATIONS

The application claims priority from provisional patent application No. 60/558097 filed Apr. 1, 2004.

FIELD OF THE INVENTION

This invention relates to emergency floatation equipment, more particularly, to personal floatation devices or life preservers.

BACKGROUND OF THE INVENTION

Military, police and similar personnel have particular needs in respect of life preservers. Such personnel often carry a significant amount of heavy equipment which has little or no buoyancy. Accordingly, any life preserver worn by such personnel requires sufficient buoyancy to support the weight of the equipment as well as the wearer. Additionally, the life preserver should not affect their manoeuvrability or access to their equipment. Assault parties and casualty response units in particular require the protection of a life preserver which does not interfere with the operations the personnel need to perform.

It is also desirable that the inflated life preserver rotate the wearer, weighted with equipment, from a face down to a face up position in water and maintain the wearer's face out of the water. This requirement has been difficult to achieve.

SUMMARY OF THE INVENTION

A broad aspect of the invention provides an inflatable life preserver, capable of being in an inflated state and an uninflated state, comprising: a structural overshell which defines the size and shape of the life preserver in the inflated state; and a gas retention bladder fitted within the overshell; wherein the overshell bears the expansion force of a gas within the bladder in the inflated state.

In some embodiments, the-overshell defines inflatable side portions wherein, when the life preserver is in an uninflated state, the side portions are confined to sides of at least a portion of a chest area of a wearer and, when the life preserver is in an inflated state, the side portions extend laterally over the chest area of the wearer.

In some embodiments, the bladder comprises at least two separate gas retention chambers wherein each of the gas retention chambers is sized to hold at least sufficient gas to fully inflate the life preserver.

In some embodiments, the overshell further comprises one or more fasteners adapted to retain the life preserver in a stored configuration when the life preserver is in an uninflated state and wherein the expansion force of the gas within the bladder as the bladder is filled releases the fasteners.

In some embodiments, each side portion includes a longitudinally extending internal baffle and the gas retention bladder is routed around the baffle and wherein the baffle bears part of the expansion force of the gas within the bladder in the inflated state.

In some embodiments, the gas retention bladder comprises a plurality of separate bladder means.

Another broad aspect of the invention provides, an inflatable life preserver, capable of being in an inflated state and an uninflated state, comprising inflatable side portions wherein, when the life preserver is in an uninflated state, the side portions are confined to sides of at least a portion of a chest area of a wearer and, when the life preserver is in an inflated state, the side portions extend laterally over the chest area of the wearer.

In some embodiments, the inflatable life preserver further comprises a head support with laterally extending lobes.

In some embodiments, the inflatable life preserver further comprises a self inflating means behind the head support.

In some embodiments, the self inflating means includes at least one compressed gas canister positioned behind the head support wherein the at least one compressed gas canister has an outlet on a lateral side of the life preserver.

In some embodiments, the inflatable life preserver further comprises one or more fasteners adapted to hold the life preserver in a stored configuration in which the head support folds to cover the self inflating means when the life preserver is in an uninflated state and wherein the expansion force of the gas when the life preserver is filled releases the fasteners.

In some embodiments, the inflatable life preserver further comprises a guiding means for guiding movement of the side portions to a desired location upon inflation and for maintaining the inflated side portions in the desired location once inflated.

In some embodiments, the inflatable life preserver further comprises a self inflating means activated by a cabling system comprising at least one cable encased in a sleeving mean which routes the cable though the life preserver.

In some embodiments, the overshell defines the size of the life preserver in the inflated state.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
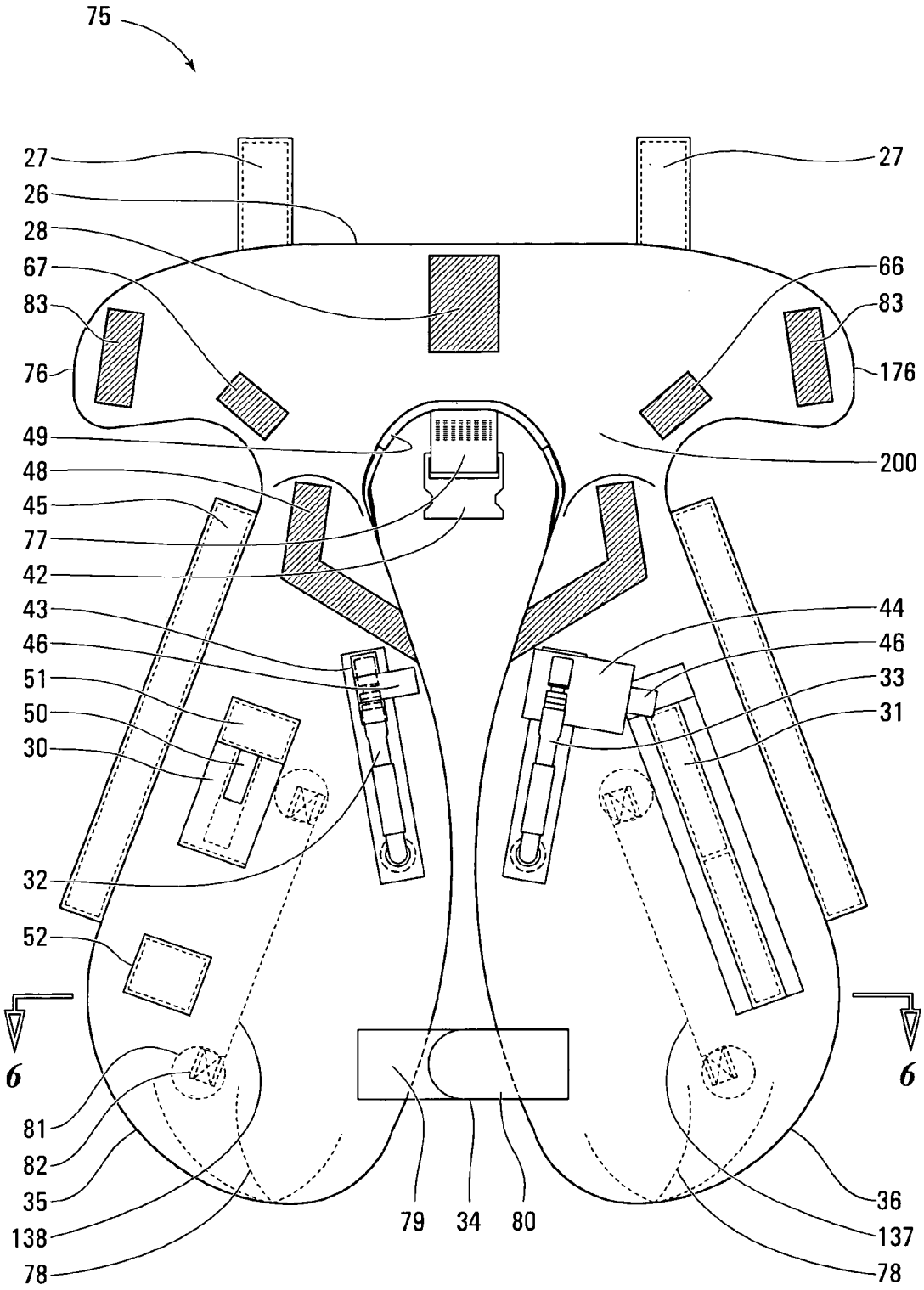
FIG. 1 is a front view of an embodiment of the invention in an inflated state.

FIG. 1 shows a life preserver 75 in an inflated state. The life preserver 75 includes an overshell 200 which defines a left front pod 36, a right front pod 35, and a life preserver head support 26. The shape and size of the left front pod 36, the right front pod 35 and the life preserver head support 26 are defined by the overshell 200. The overshell 200 has no air retention requirements. The overshell 200 is comprised of a fabric which is sewn to define the shape of the life preserver 75. Accessories can be directly sewn to the overshell 200. Some stitching lines 78 are shown in FIG. 1 which indicate that the overshell 200 defines a three dimensional shape for the left front pod 36, the right front pod 35 and the life preserver head support 26 in the inflated state.

The life preserver head support 26 has a central portion, a left lobe 176 and a right lobe 76. The central portion of the life preserver head support defines an inward side which has an arc shaped to fit a neck of a wearer between the left front pod 36 and the right front pod 35. The left lobe 176 extends laterally leftward from the central portion of the life preserver head support 26 and the right lobe 76 extends laterally rightward from the central portion. The central portion of the life preserver head support 26 connects to an upper end of the right front pod 35 and to an upper end of the left front pod 36. The lobes 76, 176 extend over the right front pod 35 and the left front pod 36, respectively. The lobes 76 and 176 of the life preserver head support 26 elongate the head support laterally to provide additional flotation stability and maximize buoyancy while maintaining a small design radii.

The life preserver head support 26 includes a padded collar 49. The padded collar 49 is positioned around the inward side of the life preserver head support 26. The padded collar 49 is preferably comprised of a soft durable fabric.

The life preserver head support 26 also includes a fabric connector 77 and an upper tail extension buckle 42. The fabric connector 77 is positioned behind the padded collar 49 and extends downwardly from the life preserver head support 26. The upper tail extension buckle 42 is located at a lower end of the fabric connector 77. The upper tail extension buckle 42 is held on the fabric connector 77 by means of stitching. Stitching may be also used to connect the fabric connector 77 to the life preserver head support 26.

The life preserver head support 26 further includes Velcro™ fasteners, namely head support packaging fastener hooks 27, head support packaging fastener loop 28, head support packaging fastener loops 83, left pod packaging fastener loop 66 and right pod packaging fastener loop 67. The head support packaging fastener hooks 27 extending outwardly from an outer edge of the life preserver head support 26 with the hook surface facing towards the rear of the life preserver head support 26. The loop surfaces of the packaging fastener loops 28, 83, 66 and 67 face the front of the life preserver head support 26. The head support loop fastener patches 83 are located adjacent outer edges of the head support lobes 76 and 176. The left pod packing fastener 66 and right pod packing fastener 67 are located adjacent the upper outer ends of the left front pod 36 and the right front pod 35 respectively. The head support packaging fastener loop 28 is located centrally on the life preserver head support 26. The life preserver head support also includes a head support packing fastener loop 60 (see FIG. 2). The use of the head support packaging fastener hooks and loops 27, 28, 60, 83, 66 and 67 is explained in further detail below.

The left front pod 36 and the right front pod 35 have a generally flattened tear drop shape. The left front pod 36 has an internal left pod baffle 37 (see FIG. 6) and the right front pod 35 has an internal right pod baffle 38 (see FIG. 6), both extending in a central location. Stitching lines 137 and 138 of FIG. 1 indicate the location of the baffles 37 and 38 internal to the life preserver 75. The left pod baffle 37 connects a front surface of the left front pod 36 to a rear surface of the left front pod 36. Similarly, the right pod baffle 38 connects a front surface of the right front pod 35 to a rear surface of the right front pod 35. The baffles 37 and 38 are fabric which are stitched to the pods 35 and 36 along stitching lines 137 and 138. Reinforcing patches are provided at upper and lower ends of the baffles 37 and 38. The reinforcing patches are stitched into position by reinforcement patch stitching 81 and 82. The reinforcement patches held by the reinforcement patch stitching 81 and 82 reinforce the attachment of the baffles 37 and 38 to the pods 36 and 35 at the ends of the baffles 37 and 38 where stresses on the baffles 37 and 38 are greatest when the life preserver 75 is in an inflated state.

The life preserver 75 includes an cross pod connection fastener 34 sewn to the overshell 200 adjacent a lower end of the left front pod 36 and a lower end of the right front pod 35. The cross pod connection fastener 34 is comprised of a right fastener loop 79 and a left fastener hook 80. The right fastener loop 79 extends over a left side of the right front pod 35. The left fastener hook 80 extends over a right side of the left front pod 36. The cross pod connector fastener 34 is preferably a Velcro™ style fastener. The cross pod connection fastener 34 is fastened as shown in FIG. 1 when the life preserver 75 is in an inflated state. The use of the cross pod connection fastener 34 by the wearer is optional.

The life preserver 75 also includes a right oral tube 32 and a left oral tube 33. The right oral tube 32 projects out of the right front pod 35 adjacent an upper left side of the right front pod 35. The left oral tube 33 projects out of the left front pod 36 adjacent an upper right side of the left front pod 36. The oral tubes 32 and 33 can be of a type know in the art. Associated with the oral tubes 32 and 33 are a left oral tube holder 44 and a right oral tube holder 43 which are sewn to the overshell 200. The oral tubes 32 and 33 are normally maintained in a stored position. The right oral tube 32 is held in position by a right oral tube holder 43 and the left oral tube 33 is normally held in position by the left oral tube holder 44. Each of the tube holders 43 and 44 has associated with it an oral tube release pull tab 46. The oral tube holders 43 and 44 hold the oral tubes 32 and 33 by the use of hook and loop Velcro™ fasteners. In the embodiment shown in FIG. 1, the right oral tube holder 43 is shown in a stored condition and the left oral tube holder 44 is shown in a released condition. The oral tube holders 43 and 44 are opened by pulling outward on the oral tube holder pull tabs 46. When released, the oral tubes 32 and 33 pivot about their lower ends to allow their upper ends to be positioned to be blown into by the wearer. The oral tubes 32 and 33 are used to inflate the life preserver 75 should the inflation system not operate. The oral tubes 32 and 33 are also used to deflate the life preserver 75.

The life preserver 75 also includes front pod outer packaging fastener hooks 45 and inner pod packaging fastener loops 48. The front pod outer packaging fastener hooks 45 extend along outer edges of the left front pod 36 and the right front pod 35. The inner pod packaging fastener loops 48 extend in a generally L shape adjacent the upper end of the left front pod 36 and the right front pod 35. Lower ends of the inner pod packaging fastener loops 48 are visible in FIG. 2. Each pair of inner pod packaging fastener loops 48 and the front pod outer packaging fastener hooks 45 together define a hook and loop type Velcro™ fastener which mate with each other and hold the front pods 35, 36 in the stored state when the life preserver 75 is deflated and folded.

The life preserver 75 further includes optional left and right reflective patches 30 and 31 sewn to the overshell 200. The right reflective patch 30 extends centrally on the right front pod 35 and the left reflective patch 31 extends centrally on the left front pod 36. The right reflective patch 30 is shown in FIG. 1 in a stored position. In this position, the reflective material is concealed by a backing material. The right reflective patch 30 includes a reflective patch storage fastener 51, a reflective patch pull tab 50 and reflective patch deployment fastener 52. The reflective patch storage fastener 51 is located at an upper end of the right reflective patch 30. The reflective patch storage fastener 51 is a hook and loop style Velcro™ fastener. Below the reflective patch storage fastener 51 is the reflective patch pull tab 50 which is used to release the right reflective patch 30 from its stored position to an unveiled position. The reflective patch deployment fastener 52 is located on the right front pod 35 in a position to mate with a fastener on the right reflective patch 30 when it is in an unveiled position to retain the right reflective patch 30 in the unveiled position. The left reflective patch 31 is depicted in FIG. 1 in the unveiled positioned and connected to its corresponding reflective patch deployment fastener which is not visible in FIG. 1 since it is behind the lower extent of the unveiled left reflective patch 31. Rather than employing reflective patches, the overshell 200 can alternatively be constructed of a highly visible material.

Figure 2:
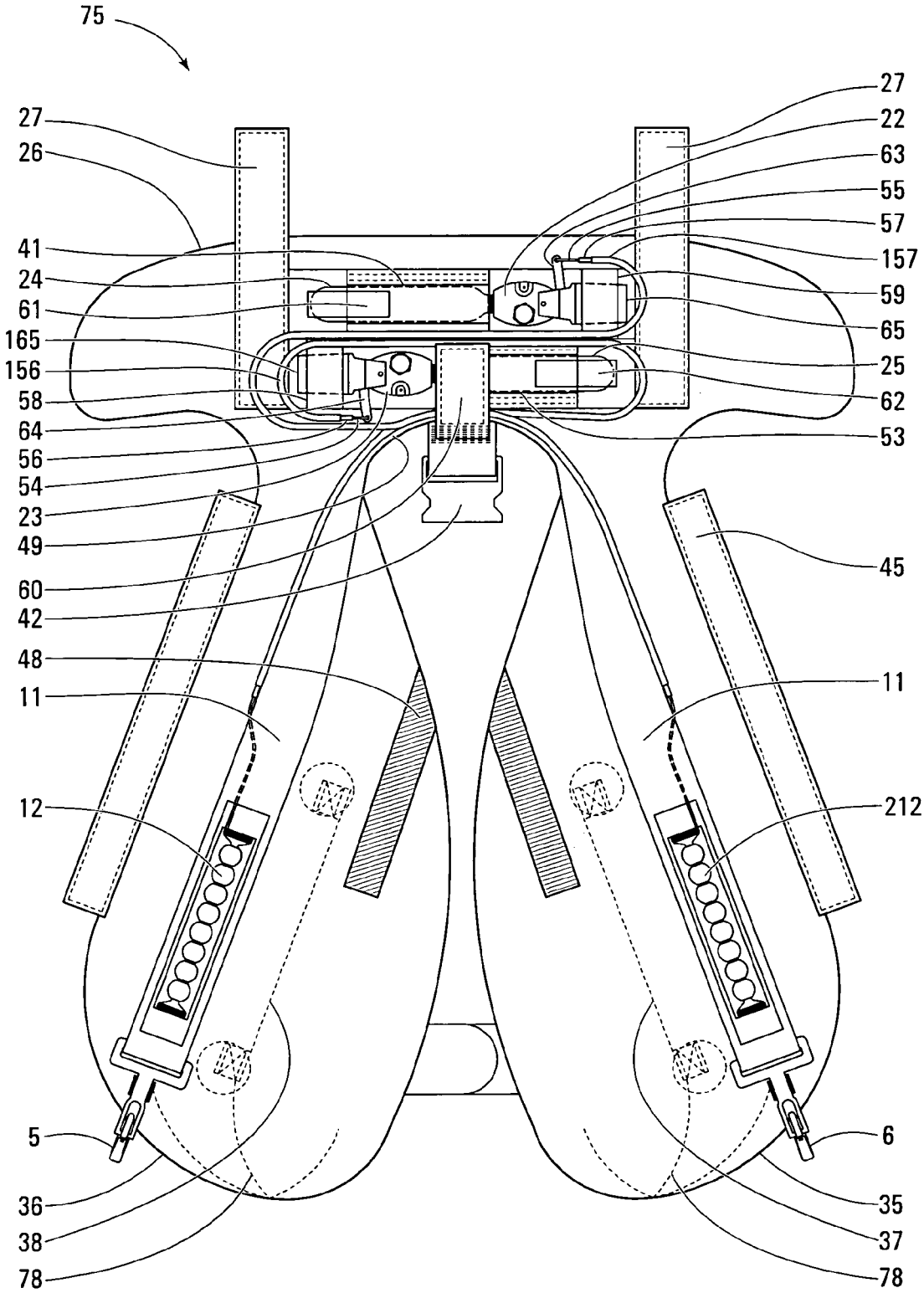
FIG. 2 is a rear view of the embodiment of FIG. 1.
Figure 3:
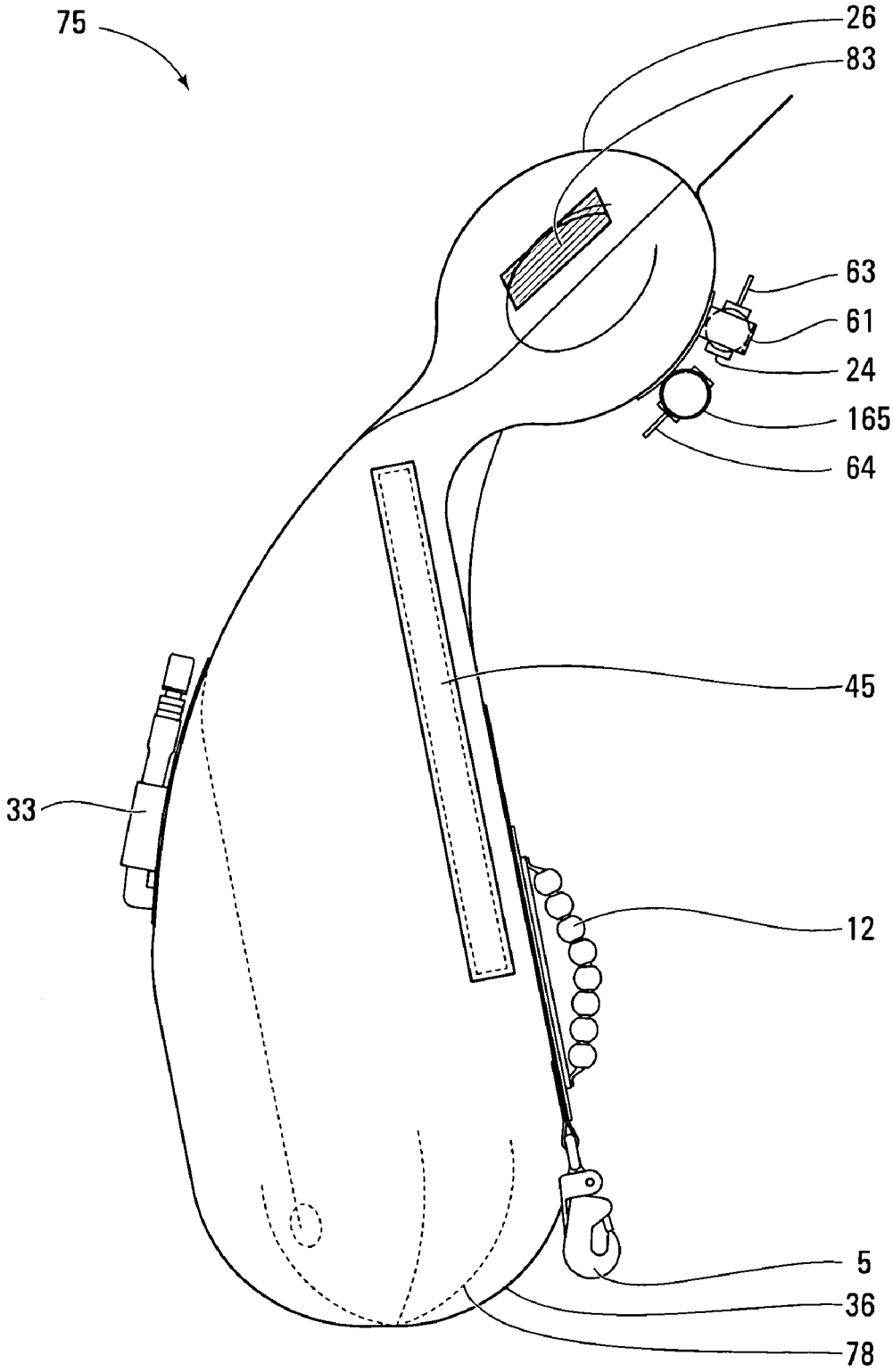
FIG. 3 is a left side view of the embodiment of FIG. 1.

FIGS. 2 and 3 show an inflation system of the life preserver 75. The life preserver 75 includes an inflation system located behind the life preserver head support 26. Upper and lower inflation systems are positioned laterally on the life preserver head support 26 and oriented in opposite directions. The upper inflation system includes an upper $CO_2$ sleeve 41, an upper $CO_2$ bottle 24, an upper $CO_2$ closure/fastener 61, an upper inflation head holder 59, an upper inflation head 22, an upper automatic inflator 65, an upper lever 63 and an upper activation cable 55. Similarly, the lower inflation system includes a lower $CO_2$ sleeve 53, a lower $CO_2$ bottle 25, a lower $CO_2$ closure/fastener 62, a lower inflation head holders 58, a lower inflation head 23, a lower automatic inflator 165, a lower lever 64 and a lower activation cable 54.

The upper inflation head holder 59 and the lower inflation head holder 58 are sewn to the rear of the life preserver head support 26. The upper $CO_2$ sleeve 41 and the lower $CO_2$ sleeve 53 are also sewn to the rear of the life preserver head support 26. The $CO_2$ tunnels are positioned in lateral alignment with the inflation head holders 58 and 59. The upper $CO_2$ bottle 24 is positioned within the upper $CO_2$ sleeve 41. The upper $CO_2$ sleeve 41 is provided with the upper $CO_2$ closure/fastener 61. The upper $CO_2$ sleeve 41 and the upper $CO_2$ sleeve closure/fastener 61 are provided with cooperating hook and loop Velcro™ fasteners to allow the upper $CO_2$ bottle 24 to be securely held within the upper $CO_2$ sleeve 41 to prevent damage or movement. Similarly, the lower $CO_2$ sleeve 53 is provided with the lower $CO_2$ sleeve closure/fastener 62 which holds the lower $CO_2$ bottle 25.

The upper inflation head 22 is axially connected at one end to the upper $CO_2$ bottle 24 and at the other end to the upper automatic inflator 65. The lower inflation head 23 is axially connected at one end to the lower $CO_2$ bottle 25 and at the other end to the lower automatic inflator 165. The upper automatic inflator 65 is held in position by the upper inflation head holder 59 and the lower automatic inflator 165 is held in place by the lower inflation head holder 58.

The upper inflation head 22 is connected by the upper lever 63 to the upper activation cable 55. The lower inflation head 23 is connected by the lower lever 64 to the lower activation cable 54. The activation cables 54 and 55 are preferably woven metal stainless steel cables such as 1.2 mm bicycle cables or coated Teflon™ cables.

The inflation system further includes sleeves 56 and 57 and cable guides 156 and 157. The cables 54 and 55 extend through sleeves 56 and 57, respectively. The sleeves 56 and 57 can comprise polymer tubing and are used to minimize snagging. The sleeves 56 and 57 in turn are threaded through cable guides 156 and 157, respectively. The cable guides 156 and 157 can be nylon webbing material.

The life preserver 75 also includes a left inflation handle 12 and a right inflation handle 212. The cable guides 156 and 157 are sewn to the rear of the life preserver 75 and guide the cables 54 and 55 around the respective inflation systems and down the rear face of the life preserver 75 to connect with the inflation handles 12 and 212. The routing of the cable guides 156 and 157 is intended to minimize resistance from restrictions which can be caused by tight radius turns.

The inflation heads 22 and 23 include a means of piercing an end of the $CO_2$ bottles 24 and 25. The $CO_2$ bottles are pierced in a lateral direction of the life preserver head support 26. The inflation heads 22 and 23 also include internal channels for directing the $CO_2$ gas into the life preserver 75. The $CO_2$ bottles 24 and 25, the inflation heads 22 and 23, the automatic inflators 65 and 165, and the levers 63 and 64 operate in a known manner. In the embodiment of FIG. 1, the inflation heads 22 and 23 include HR 85000 series automatic inflators. The inflation heads 22 and 23 may include reusable clips to help prevent unintentional inflation.

A main harness 11 is provided on the life preserver 75 which extends centrally up a rear surface of each of the front pods 35, 36 and across the inner side of the life preserver head support 26. The inflation handles 12 and 212 are located adjacent bottom ends of the main harness 11. The main harness 11 is typically a heavy duty fabric strap which is sewn into position. The cable guides 156 and 157 extend along an edge of the main harness 11. The inflation handles 12 and 212 are held in position on the main harness 11 by hook and loop Velcro™ fasteners (not shown) to prevent unintentional inflation. Worry beads are provided on the inflation handles 12 for easy gripping by the wearer. The main harness 11 includes left front attachment hook 5 and right front attachment hook 6. The front attachment hooks 5 and 6 are located at the bottom ends of the main harness 11. The front attachment hooks 5 and 6 allow the life preserver to be attached to a secondary harness system (see FIGS. 7 and 8).

Figure 4:
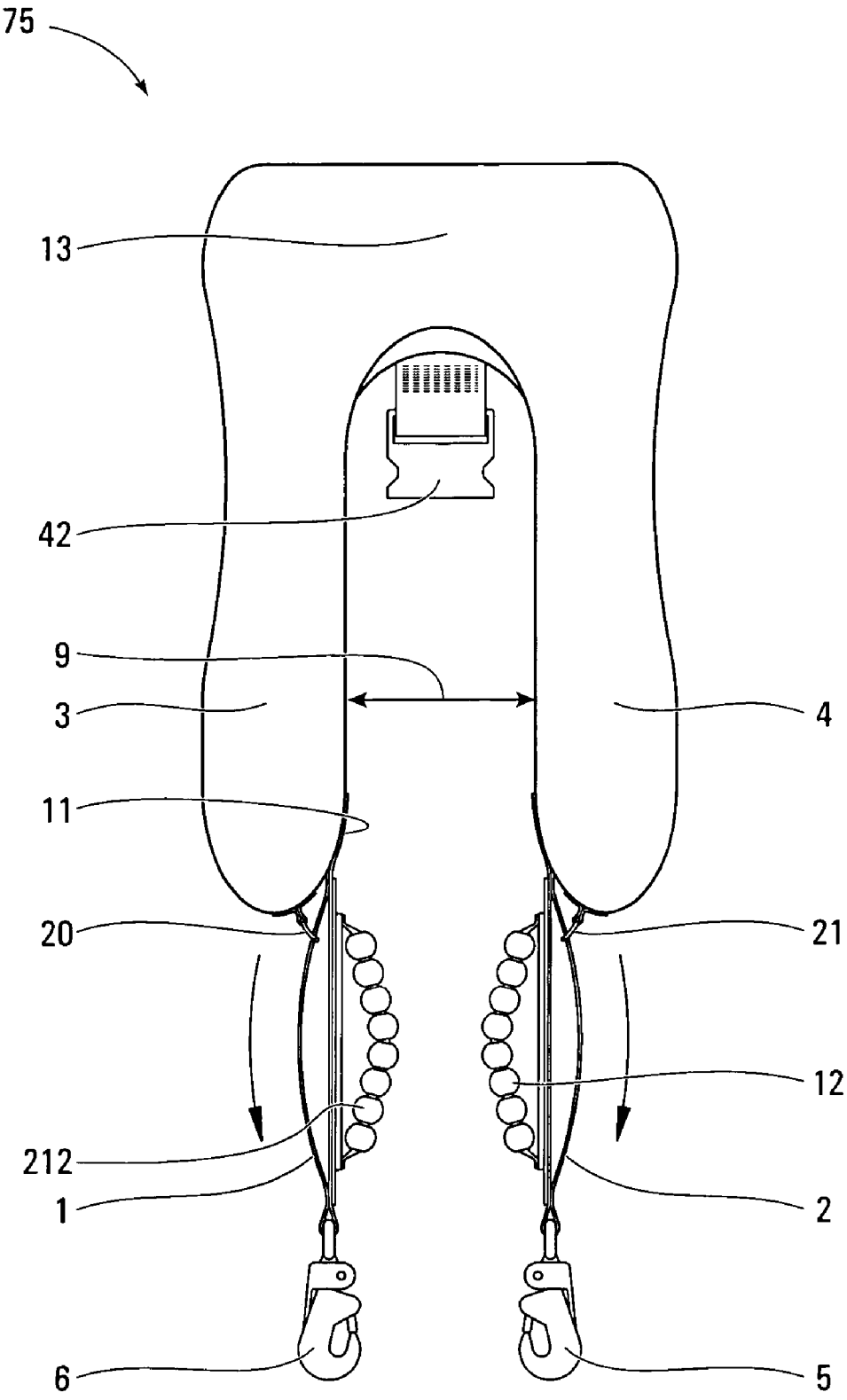
FIG. 4 is a front view of the embodiment of FIG. 1 in a deflated and stored state.

FIG. 4 shows the life preserver 75 in a deflated and stored state. FIG. 4 shows a stored life preserver head support 13, a stored right front pod 3 and stored left front pod 4. A load carriage area 9 is defined between the stored right front pod 3 and the stored left front pod 4. The life preserver 75 in the stored state of FIG. 4 is configured such that the stored right front pod 3 and the stored left front pod 4 rest on the outer chest of the wearer so that the large load carriage area 9 is defined between the stored right front pod 3 and the stored left front pod 4.

The main harness 11 includes a right slide rail 1 extending downward from the stored right front pod 3 on an opposite face to the right inflation handle 212, i.e. on the outside face of the main harness 11. Similarly, the main harness 11 includes a left slide rail 2 which extends downward from the stored left front pod 4 on an opposite face to the left inflation handle 12. A left side rail loop 21 is attached to a bottom end of the stored left front pod 4. The left slide rail 2 extends through the loop of the left side rail loop 21. Similarly, a right side rail loop 20 is attached to a bottom end of the stored right front pod 3 and the right side rail 1 extends through the loop of the right side rail loop 20.

The slide rails 1 and 2 are slightly slack when the life preserver 75 is in an uninflated state but are taught when the life preserver 75 is in an inflated state. The slack is taken up in the inflated state by a small loop formed in the slide rails 1 and 2 which contains the slide rail loops 20 and 21.

Figure 5:
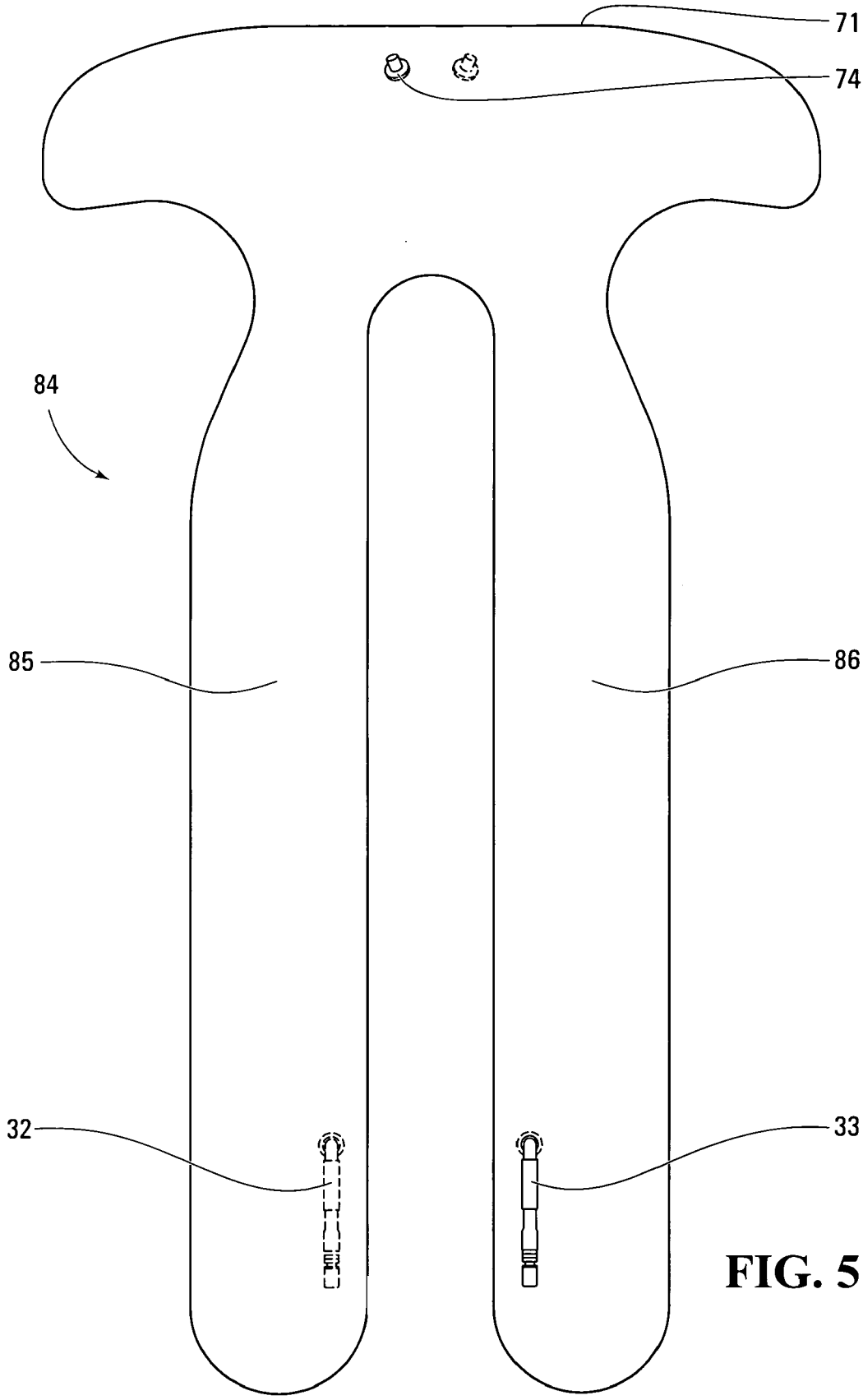
FIG. 5 is a front view of a bladder of the embodiment of FIG. 1.

FIG. 5 shows an inflatable bladder 84 which is located within the overshell 200 of the life preserver 75. The bladder 84 is gas impermeable and is inflated within the life preserver 75 to provide the life preserver 75 with buoyancy. The inflatable bladder 84 has a bladder head support section 71. Two inflation valves 74 are defined in the bladder head support section 71. The inflation valves 74 are connected to the inflation system depicted in FIG. 2 to allow inflation of the inflatable bladder 84 by the $CO_2$ in the $CO_2$ bottles 24 and 25. The inflatable bladder 84 also has a right inflatable leg 85 and a left inflatable leg 86. The right inflatable leg 85 and the left inflatable leg 86 of the inflatable bladder 84 are substantially longer than the left front pod 36 and the right front pod 35. The inflatable bladder 84 is positioned within the life preserver 75 such that the inflatable legs wrap around the baffles 37 and 38. In particular, a top portion of the right inflatable leg 85 is positioned to the right of the right pod baffle 38, the middle of the right inflatable leg 85 is wrapped around a bottom end of the right pod baffle 38 and a bottom portion of the right inflatable leg 85 extends upwardly along the inner side of the right pod baffle 38 such that the oral tube 32 which is depicted as extending downwardly in FIG. 5 extends upwardly and out through a hole in the overshell 200 as shown in FIG. 1. The left inflatable leg 86 is wrapped around the left pod baffle 37 in a similar manner such that the upper portion of the left inflatable leg 86 is to the left of the left pod baffle 37, the middle of the left inflatable leg 86 wraps around a bottom end of the left pod baffle 37 and a bottom portion of the left inflatable leg 86 extends up the inside of the left front pod 36 such that the left oral tube 33 which is depicted as extending downwardly in FIG. 5 extends upwardly and out through a hole in the overshell 200 as shown in FIG. 1.

Figure 6:
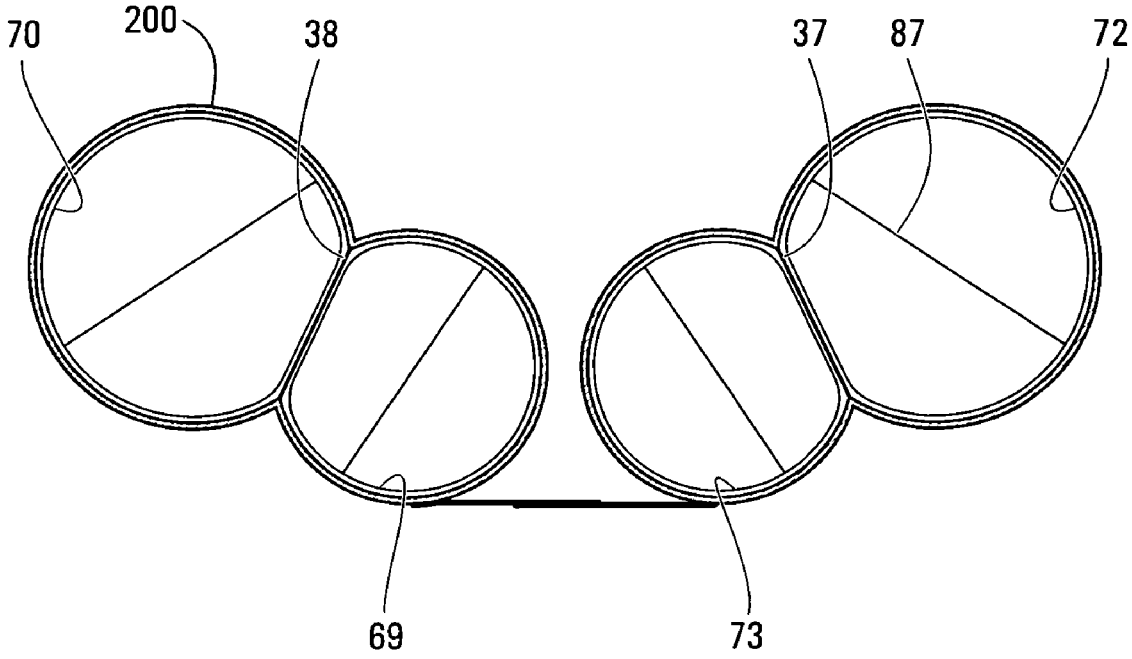
FIG. 6 is a cross sectional view of the embodiment of FIG. 1 taken along section 6—6.

FIG. 6 depicts a cross section the life preserver 75 showing the left pod baffle 37 and the right pod baffle 38. It can also be seen that the bladder also has a bladder baffle 87. The bladder baffle 87 divides the bladder into two isolated chambers. In FIG. 6, both chambers are shown to be inflated. A right outward bladder section 70 is shown which is comprised of an upper portion of the right inflatable leg 85. A right inward bladder section 69 is shown which is comprised of the lower portion of the right inflatable leg 85. Similarly, a left outward bladder section 72 is shown which is comprised of an upper portion of the left inflatable leg 86 and a left inward bladder section 73 is shown which is comprised of a lower portion of the left inflatable leg 86. The bladder sections 70, 69, 72 and 73 are all held within the overshell 200. FIG. 6 shows how the baffles 37 and 38 constrain the bladder 84.

The oral tubes 32 and 33 access separate chambers of the bladder 84. One of the valves 74 connects the upper inflation system to one of the chambers of the bladder 84 and the other of the valves 74 connects the lower inflation system to the other of the chambers of the bladder 84. This allows inflation of both chambers of the bladder 84 orally and by use of the inflation system.

In one embodiment, the bladder 84 is formed of a 3 ply polyurethane film. The polyurethane film is bonded around the seams to retain gas. The bladder 84 fits inside the overshell 200. The bladder 84 is preferably formed from sufficient material to inflate all of the shape defined by the overshell 200. The bladder 84 is preferably non-structural meaning that the inflated shape of the bladder 84 within the life preserver is dictated only by the shape of the overshell 200. The overshell 200 constrains the bladder 84 and takes up all of the expansion force of the gas within the bladder 84.

The life preserver 75 is intended to be fastened to a secondary harness system. Exemplary secondary harness systems are depicted in FIGS. 7 and 8.

Figure 7:
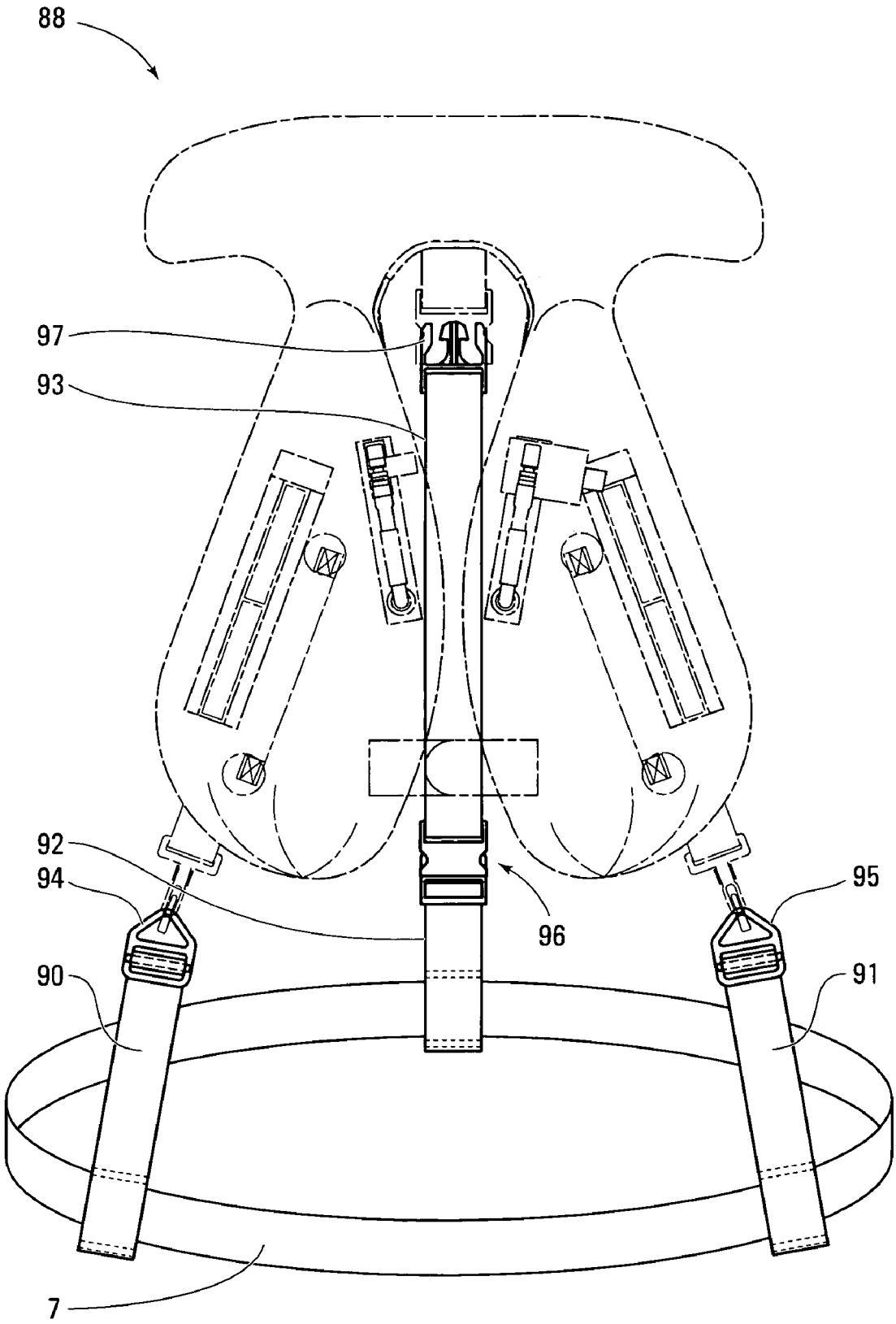
FIG. 7 is a schematic view of a climbing harness system for use with the embodiment of FIG. 1.

The secondary harness system 88 of FIG. 7 is a climbing style harness. It includes a secondary harness waistband 7. The harness system 88 also includes a right waistband harness strap 90, a left waistband harness strap 91 a rear waistband harness strap 92, and a waistband harness strap extension 93. The waistband harness straps 90, 91 and 92 have sewn cloth loops through which the secondary harness waistband 7 is threaded. At an upper end of the right waistband harness strap 90 is a right harness loop buckle 94. At an upper end of the left waistband harness strap 91 is a left harness loop buckle 95. Each of the loop buckles 94, 95 are attached to the respective left and right waistband harness straps 90 and 91 by the cloth of the straps being threaded through a lower portion of the buckle and sewn down. The upper loops of the harness loop buckles 94 and 95 are sized to mate with the left front attachment hook 5 and the right front attachment hook 6 respectively when the life preserver 75 is worn with the harness system 88. The rear waistband harness 92 is attached to the secondary harness waistband 7 in the same way as the left and right waistband harness straps 91, 90. At an upper end of the rear waistband harness strap 92, and at a lower end of the rear waistband harness extension 93 are mating male and female buckles 96. At an upper end of the rear waistband harness strap extension 93 is located a male buckle 97. In use, the male buckle 97 clips to the upper tail extension buckle 42 which, in combination with the mating male and female buckles 96 attach the life preserver 75 to the rear waistband harness strap 92. The waistband 7 will also have attached to it crotch straps (not shown) which are attached to the legs of the wearer to retain the waistband 7 at waist level.

Figure 8:
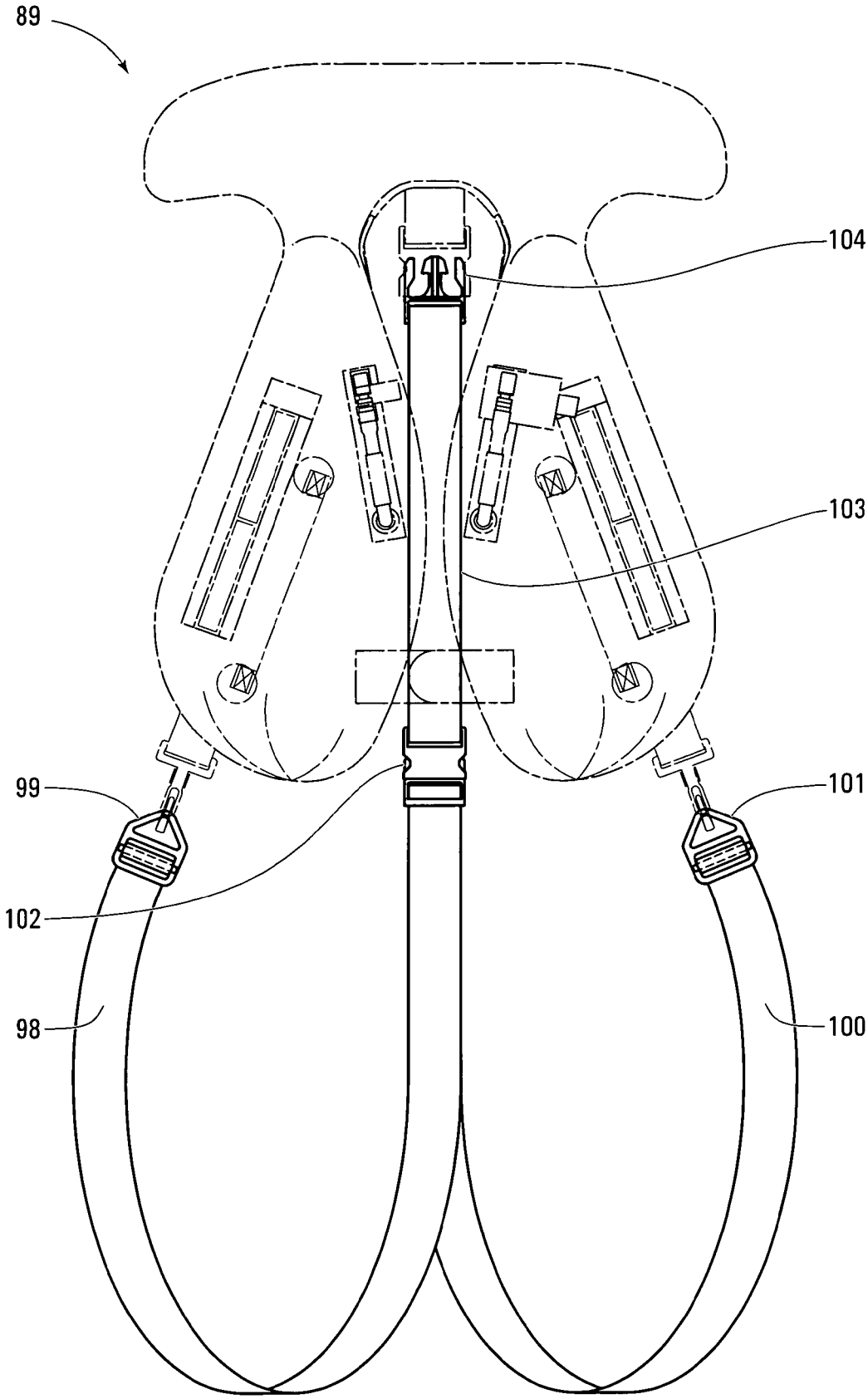
FIG. 8 is a schematic view of Y harness system for use with the embodiment of FIG. 1.

FIG. 8 shows a different secondary harness system 89. In this system, there is no waistband. Instead, there is a right leg strap 98, a left leg strap 100 and a rear leg strap extension 103. At a forward end, the right leg strap 98 connects to a right leg strap buckle 99 which is shaped to mate with the right front attachment hook 6. Similarly, a left leg strap 100 has a left leg strap buckle 101 at a forward end which is adapted to attach to the left front attachment hook 5. At a rearward end of the right leg strap 98 and the left leg strap 100 there are mating male and female buckles 102. The female portion of the mating male and female buckles 102 is connected to both the right leg strap 98 and the left leg strap 100. The male portion of the mating male and female buckles 102 is connected to the rear leg strap extension 103. At an upward end of the rear leg strap extension 103 is a male buckle 104. In use, the male buckle 104 clips to the upper tail extension buckle 42. The mating male and female buckles 102 connect the rear leg strap extension 103 to the right leg strap 98 and the left leg strap 100. The right leg strap 98 is threaded through the legs of the wearer and clipped to the right front attachment hook 6 via the right leg strap buckle 98. Similarly, the left leg strap 100 is threaded forward through the legs of the wearer and clipped to the left front attachment hook 5 via the leg strap buckle 101. The harness systems position the front pods 35 and 36 to the outer chest area of the wearer. Although no adjustment means are depicted in FIGS. 9 and 10, it will be understood by a person skilled in the art that the straps may include adjustment means to compensate for users of different sizes.

The secondary harness systems of FIGS. 7 and 8 act as a base for the life preserver 75 to be quickly doffed and donned by connecting the life preserver 75 to the wearer via releasable buckles. The secondary harness systems depicted in FIGS. 7 and 8 use a three point mating system with two attachment points located on the front and one located centrally behind the head. However, it will be understood that other harness configurations may be used to meet the needs of different applications.

Figure 9A:
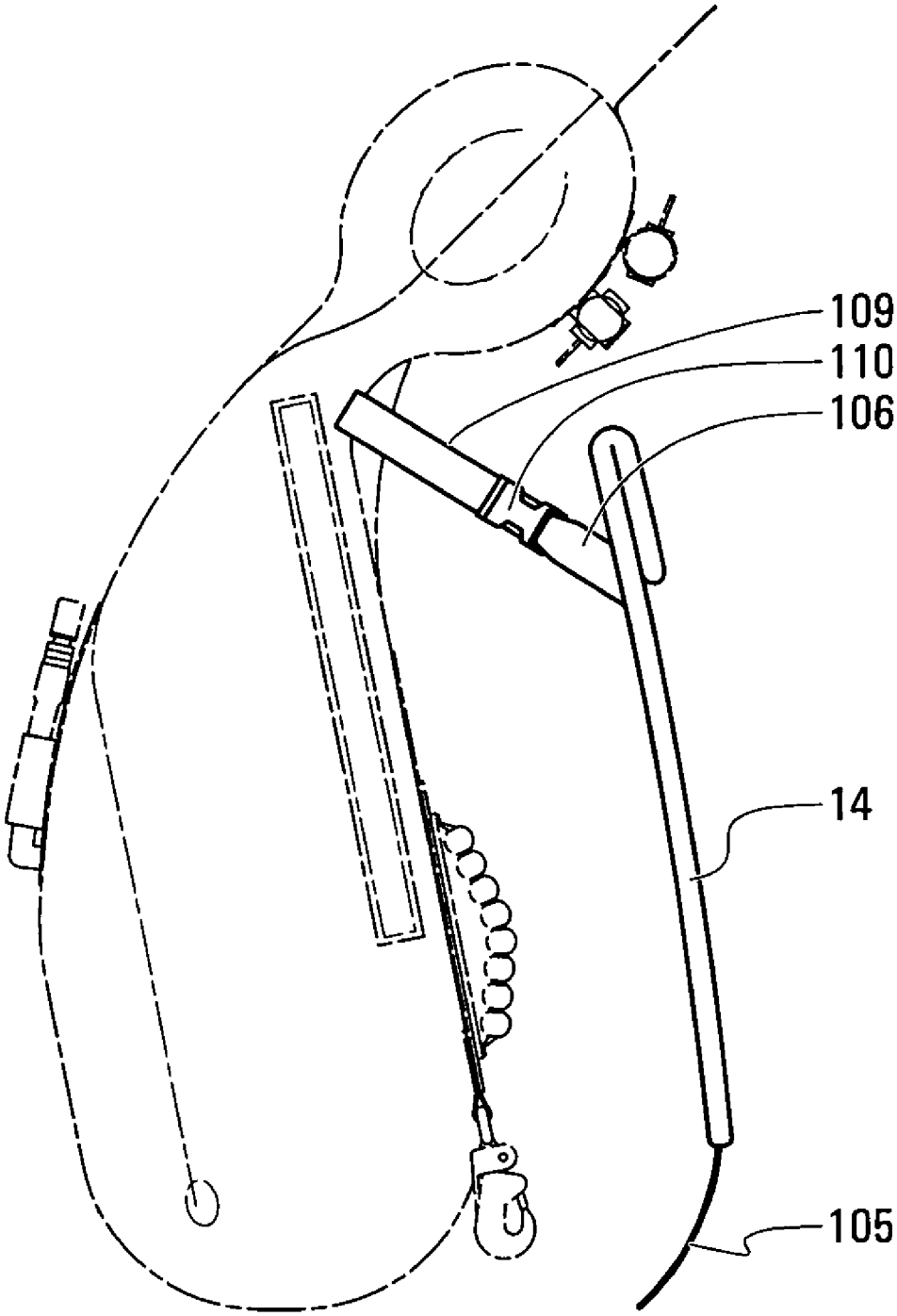
FIGS. 9A and 9B are a side view and a front view respectively of a hydration system fitted to the embodiment of FIG. 1.
Figure 9B:
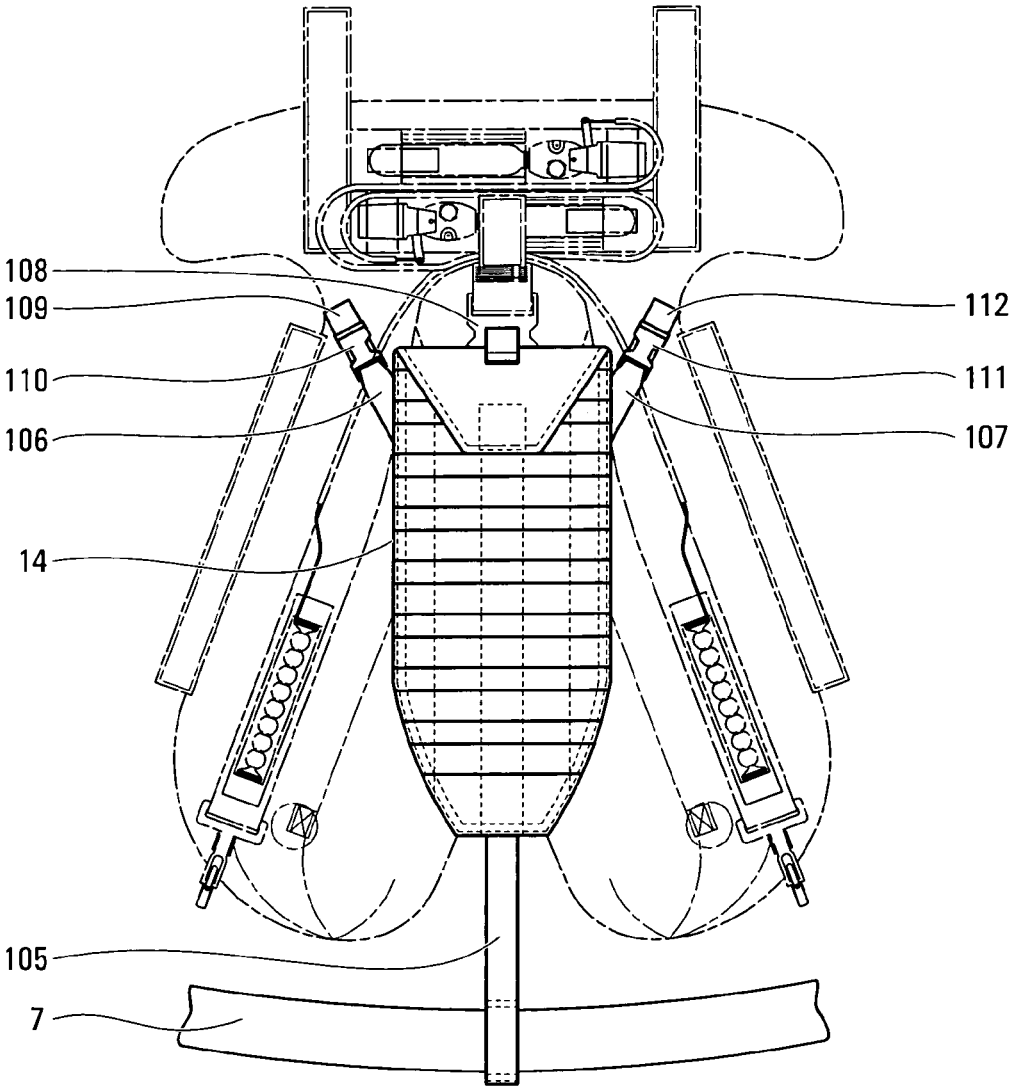
Figure 10:
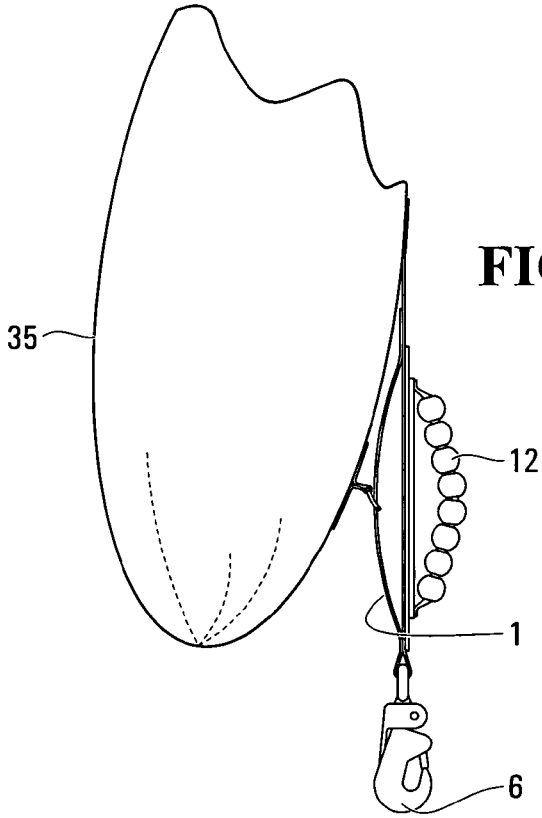
FIG. 10 is a partial side view of the embodiment of FIG. 1 in a partially inflated condition.

FIGS. 9A and 9B depict a hydration system 14 which may be positioned on the rear of the user in place of the rear waistband harness strap extension 93 shown in FIG. 7. The hydration system 14 has a hydration system waiststrap 105 extending downwardly for attachment to the secondary harness waistband 7. Adjacent the upper sides of the hydration system 14 are a right hydration system shoulder strap 107 and a left hydration system shoulder strap 106. In the embodiment of FIGS. 9A and 9B, the life preserver 75 is provided with shoulder attachments straps 109 and 112 which mate with the left hydration system shoulder strap 106 and the right hydration system shoulder strap 107 through mating buckles 110 and 111, respectively. A hydration system buckle 108 is located at a midpoint of the top of the hydration system 14 and is sized to mate with the upper tail extension buckle 42. In use, the hydration system 14 has a known hydration vessel (not shown) comprising a bladder, an oral hydration tube and a filling cap. The oral hydration tube is of sufficient length that it can be routed to the front of the life preserver 75 and secured by a Velcro™ fastener (not shown).

Figure 11:
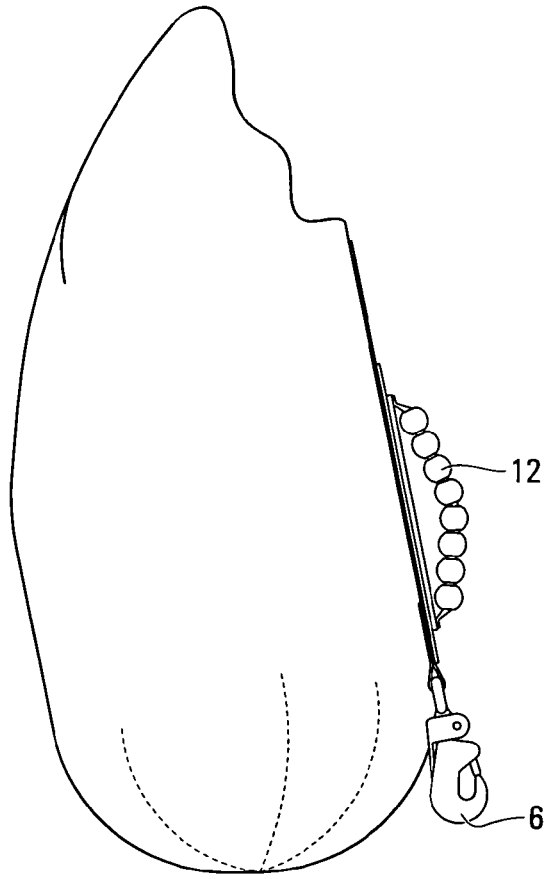
FIG. 11 is a partial side view of the embodiment of FIG. 1 in a fully inflated condition.

The inflation of the life preserver 75 is as follows. The life preserver system is initially in the stored state as depicted in FIG. 4. The life preserver 75 is attached to a harness system such as those depicted in FIGS. 7 to 9 to maintain the life preserver on the wearer. The wearer grasps the inflation handles 12 and 212 which, when the life preserver is worn by a wearer, are located against the wearer's chest. The inflation handles 12, 212 are held to the main harness 11 by hook and loop Velcro™ fasteners. The user firmly pulls downward on the inflation handles 12 and 212 to at least partially detach the inflation handles 12, 212 from the main harness 11. Pulling downward on the inflation handles 12, 212 in turn pulls the upper activation cable 55 and the lower activation cable 54 which are connected to the inflation handles 12 and 212. The pulling of the activation cables 54 and 55 moves the levers 63 and 64 which manually initiate inflation by piercing the $CO_2$ bottles 24 and 25 in a manner known in the art. Gas from the $CO_2$ bottles enters the bladder 84 through the inlet valves 74. As gas enters the inlet valves 74, the bladder 84 is inflated and fills the overshell of the life preserver 75. As the gas fills the bladder 84, the expanding bladder stresses and releases the hook and loop Velcro™ fasteners 45, 48, 27, 28, 66, 67 and 83 which hold the life preserver 75 in the stored state. As the overshell 200 fills, the left and right slide rail loops 20 and 21 ride along the left and right slide rails 1 and 2 from the position shown in FIG. 4 through the position shown in FIG. 10 to a final position shown in FIG. 11. The combination of the slide rail loops 20 and 21 and the slide rails 1 and 2 keep the front pods 35 and 36 against the main harness 11 and therefore against the wearer as the life preserver 75 is inflated and maintains this position in the fully inflated state. The slide rail system allows the front pods to be stored on the upper chest while ensuring that in the inflated state the front pods do not lift from the harness.

As previously noted, the bladder has two separate chambers which are isolated from each other. If either chamber is pierced, the other chamber can be inflated to fully inflate the life preserver 75 independently. The inflation system also has automatic inflators 65 and 165 which are of a means known in the art. Automatic inflators 65 and 165 are designed to pierce the $CO_2$ bottles 24 and 25 if the life preserver 75 is immersed in water. In one embodiment, this is done by the use of salt tablet which dissolves when wet. The bladder may be formed of any suitable material and may have only one chamber or a plurality of chambers.

If the inflation system fails, the life preserver 75 can alternatively by inflated by the use of the oral tubes 32 and 33 which the user can blow into to inflate the life preserver 75.

The oral tubes 32 and 33 have valves of the type known in the art which allows for the inflation of the life preserver 75. The oral tubes 32 and 33 are also the means by which the life preserver 75 can be deflated. When the life preserver 75 is deflated, the life preserver 75 can be repackaged into the store position. This done by folding the lower portions of the left and right pod 35 and 36 up to the bottom of the front pod outer packing fastener 45 which is the limit of the side rails 1 and 2. The right and left pods are then rolled toward their respective front pod outer packing fasteners 45 over the oral tubes 32 and 33 so that the inner pod packing fastener align with and are mated to the front pod outer packing fasteners 45. For the head support, the head support lobes 76 are first folded over the inflation assembly along the edges of the head support packing fastener tabs 27. The head support is then rolled downwardly over the inflation assembly such that the head support hook 60 can mate with the head support loop 28 and head support hooks 27 can mate with head support loops 83, 66, and 67. The packaging of the head support over the inflation assembly helps to protect the automatic inflators heads 65 and 165 from water spray which could accidentally actuate the automatic inflators 65 and 165 by dissolving the salt tablets found therein.

A visual beacon (not shown) can also be provided on the life preserver 75. The visual beacon is covered in the life preserver's packed state such that should it be inadvertently triggered, it is not visible until the life preserver is inflated. Optionally, there is an additional cover on the beacon to allow the light to be covered when the life preserver has been inflated.

The shape of the overshell 200 preferably comforms to most body types and sits comfortably around the neck of the wearer without putting undue force on the wearer. The front pods 35 and 36 are confined to the sides of the upper chest when stored. When inflated, the front pods 35 and 36 inflate across the chest to provide buoyancy. The front pods 35 and 36 can be located wider and flatter across the chest than conventional life preservers due to the baffles 37 and 38.

If the bladder 84 were not constrained within the overshell of the life preserver 75, the bladder would inflate to a much larger size than the limitations put on by the overshell. In other words, the inflated shaped of the life preserver 75 is solely dictated by the shape of the overshell 200. The overshell 200 bears all of the force of the internal pressure. The air is actually retained by the bladder 84, but all force is transmitted to the overshell 200. Because the overshell bears the entire force load from the internal pressure, the inner bladder does not have to have a structural component and can therefore be lighter and more packable. The bladder material, in one embodiment 0.005" polyester urethane, was selected for its flexibility. The material has 300% strainability at failure. The bladder is a triple layer sandwich which creates a dual bladder system.

The maximum strength of the material of the overshell 200 is aligned with the maximum hoop force induced by the internal pressure of the bladder 84 within the overshell 200.

In one embodiment, the overshell 200 is also shaped to provide a preferential location of buoyancy for peak performance in righting the wearer and providing righted stability. The length to width aspect ratio of each of the front pods 35 and 36 is 1.6 giving a total aspect ratio of 3.2 across the chest. The baffled design of the structural overshell 200 allows this aspect ratio. This wider, flatter buoyancy yields a more stable platform in water situations. Additionally, the wide lobes 76 and 176 on the head support 26 of the life preserver 75 similarly give a more stable platform in the water. The footprint of the life preserver is extremely large with respect to its thickness and the size of a nominal human torso.

In the embodiment of FIG. 1, the life preserver 75 is capable of 65 lbs nominal buoyancy at a design pressure of approximately 3.5 psig and a burst pressure of 35 psig.

The overshell 200 may be formed of any suitable material and define other suitable shapes. Preferably, the material of the overshell 200 has little or no elasticity.

Although the cable guides 156 and 157 are shown to be continuous in FIG. 2, it will be understood that the cable guides 156 and 157 may be comprised of spaced sections and the cables 54 and 55 may be routed in other directions than that shown in FIG. 2.

The life preserver 75 may be encased in an overall cover that breaks apart upon inflation of the life preserver 75. Such an overall cover can be of material that has fire retardant or ballistic properties such as Nomex™.

The inflation system may also include a depth actuation system that automatically inflates the life preserver 75 at a certain depth.

Numerous modifications and variations of the present invention are possible in light of the above teachings. It is therefore to be understood that within the scope of the appended claims, the invention may be practiced otherwise than as specifically described herein.

The invention claimed is:

1. An inflatable life preserver, capable of being in an inflated state and an uninflated state, comprising:

a substantially inelastic structural overshell which defines the size and shape of the life preserver in the inflated state; and a gas retention bladder fitted within the overshell;

wherein the overshell bears the expansion force of a gas within the bladder in the inflated state.

2. The inflatable life preserver according to claim 1 wherein the overshell defines inflatable side portions wherein, when the life preserver is in an uninflated state, the side portions are confined to sides of at least a portion of a chest area of a wearer and, when the life preserver is in an inflated state, the side portions extend laterally over the chest area of the wearer.

3. The inflatable life preserver according to claim 2 wherein the overshell further defines a head support with laterally extending lobes.

4. The inflatable life preserver according to claim 3 further comprising a self inflating means behind the head support.

5. The inflatable life preserver according to claim 4 wherein the self inflating means includes at least one compressed gas canister positioned behind the head support wherein the at least one compressed gas canister has an outlet on a lateral side of the life preserver.

6. The inflatable life preserver according to claim 2 wherein the overshell further comprises one or more fasteners adapted to retain the life preserver in a stored configuration when the life preserver is in an uninflated state and wherein the expansion force of the gas within the bladder as the bladder is filled releases the fasteners.

7. The inflatable life preserver according to claim 1 wherein the bladder comprises at least two separate gas retention chambers wherein each of the gas retention chambers is sized to hold at least sufficient gas to independently fully inflate the life preserver.

8. An inflatable life preserver according to claim 1 wherein the gas retention bladder comprises a plurality of separate bladder means.

9. An inflatable life preserver, capable of being in an inflated state and an uninflated state, comprising:

a structural overshell which defines the shape of the life preserver in the inflated state; and a gas retention bladder fitted within the overshell;

wherein the overshell bears the expansion force of a gas within the bladder in the inflated state; and wherein the overshell defines inflatable side portions wherein, when the life preserver is in an uninflated state, the side portions are confined to sides of at least a portion of a chest area of a wearer and, when the life preserver is in an inflated state, the side portions extend laterally over the chest area of the wearer; and wherein the overshell further defines a head support with laterally extending lobes and a self inflating means behind the head support; and wherein the overshell further comprises one or more fasteners adapted to hold the life preserver in a stored configuration in which the head support folds to cover the self inflating means when the life preserver is in an uninflated state; and wherein the expansion force of the gas within the bladder as the bladder is filled releases the fasteners.

10. An inflatable life preserver, capable of being in an inflated state and an uninflated state, comprising:

a structural overshell which defines the shape of the life preserver in the inflated state; and a gas retention bladder fitted within the overshell;

wherein the overshell bears the expansion force of a gas within the bladder in the inflated state; and wherein the overshell defines inflatable side portions wherein, when the life preserver is in an uninflated state, the side portions are confined to sides of at least a portion of a chest area of a wearer and, when the life preserver is in an inflated state, the side portions extend laterally over the chest area of the wearer; and wherein each side portion includes a longitudinally extending internal baffle and the gas retention bladder is routed around the baffle and wherein the baffle bears part of the expansion force of the gas within the bladder in the inflated state.

11. An inflatable life preserver, capable of being in an inflated state and an uninflated state, comprising:

a structural overshell which defines the shape of the life preserver in the inflated state, the overshell defining inflatable side portions; and a gas retention bladder fitted within the overshell; and a guiding means for guiding movement of the side portions to a desired location upon inflation and for maintaining the inflated side portions in the desired location once inflated;

wherein the overshell bears the expansion force of a gas within the bladder in the inflated state; and wherein, when the life preserver is in an uninflated state, the side portions are confined to sides of at least a portion of a chest area of a wearer and, when the life preserver is in an inflated state, the side portions extend laterally over the chest area of the wearer.

12. An inflatable life preserver, capable of being in an inflated state and an uninflated state, comprising:

a structural overshell which defines the shape of the life preserver in the inflated state;

a gas retention bladder fitted within the overshell; and a self inflating means activated by a cabling system comprising at least one cable encased in a sleeving means which routes the cable though the life preserver;

wherein the overshell bears the expansion force of a gas within the bladder in the inflated state; and wherein the overshell defines inflatable side portions wherein, when the life preserver is in an uninflated state, the side portions are confined to sides of at least a portion of a chest area of a wearer and, when the life preserver is in an inflated state, the side portions extend laterally over the chest area of the wearer.

13. An inflatable life preserver, capable of being in an inflated state and an uninflated state, comprising inflatable side portions and a self inflating means activated by a cabling system comprising at least one cable encased in a sleeving means which routes the cable though the life preserver wherein, when the life preserver is in an uninflated state, the side portions are confined to sides of at least a portion of a chest area of a wearer and, when the life preserver is in an inflated state, the side portions extend laterally over the chest area of the wearer.

14. An inflatable life preserver, capable of being in an inflated state and an uninflated state, comprising inflatable side portions, the side portions each comprising an upper portion and a lower portion, wherein, when the life preserver is in an uninflated state, the side portions are confined to sides of at least a portion of a chest area of a wearer and the lower portions are folded upwards overlapping at least part of the upper portions and, when the life preserver is in an inflated state, the side portions extend laterally over the chest area of the wearer and the lower portions extend downwards from the upper portions.

15. The inflatable life preserver according to claim 14 further comprising a head support with laterally extending lobes.

16. The inflatable life preserver according to claim 15 further comprising a self inflating means behind the head support.

17. The inflatable life preserver according to claim 16 wherein the self inflating means includes at least one compressed gas canister positioned behind the head support wherein the at least one compressed gas canister has an outlet on a lateral side of the life preserver.

18. The inflatable life preserver according to claim 16 further comprising one or more fasteners adapted to hold the life preserver in a stored configuration in which the head support folds to cover the self inflating means when the life preserver is in an uninflated state and wherein the expansion force of the gas when the life preserver is filled releases the fasteners.

19. An inflatable life preserver, capable of being in an inflated state and an uninflated state, comprising inflatable side portions and a guiding means for guiding movement of the side portions to a desired location upon inflation and for maintaining the inflated side portions in the desired location once inflated wherein, when the life preserver is in an uninflated state, the side portions are confined to sides of at least a portion of a chest area of a wearer and, when the life preserver is in an inflated state, the side portions extend laterally over the chest area of the wearer.

* * * * *